US010947821B2

(12) United States Patent
Berland

(10) Patent No.: US 10,947,821 B2
(45) Date of Patent: Mar. 16, 2021

(54) OIL AND GAS PRODUCTION WELL CONTROL SYSTEM AND METHOD

(71) Applicant: Robert J. Berland, Olathe, KS (US)

(72) Inventor: Robert J. Berland, Olathe, KS (US)

( * ) Notice: Subject to any disclaimer, the term of this patent is extended or adjusted under 35 U.S.C. 154(b) by 149 days.

(21) Appl. No.: 16/110,945

(22) Filed: Aug. 23, 2018

(65) Prior Publication Data

US 2019/0063194 A1 Feb. 28, 2019

Related U.S. Application Data

(60) Provisional application No. 62/549,036, filed on Aug. 23, 2017.

(51) Int. Cl.

| | |
|---|---|
| ***E21B 43/12*** | (2006.01) |
| ***E21B 41/00*** | (2006.01) |
| ***E21B 47/06*** | (2012.01) |
| ***E21B 34/02*** | (2006.01) |
| ***E21B 43/34*** | (2006.01) |
| ***E21B 47/008*** | (2012.01) |
| *E21B 37/06* | (2006.01) |

(52) U.S. Cl.

CPC ..... *E21B 41/0092* (2013.01); *E21B 34/02* (2013.01); *E21B 43/12* (2013.01); *E21B 43/126* (2013.01); *E21B 43/128* (2013.01); *E21B 43/34* (2013.01); *E21B 47/008* (2020.05); *E21B 47/06* (2013.01); *E21B 37/06* (2013.01)

(58) Field of Classification Search

CPC .. E21B 41/0092; E21B 43/126; E21B 43/128; E21B 47/0007; E21B 47/06

See application file for complete search history.

(56) References Cited

U.S. PATENT DOCUMENTS

| | | | | |
|---|---|---|---|---|
| 6,119,781 | A * | 9/2000 | Lemetayer | E21B 43/128 166/369 |
| 7,090,027 | B1 | 8/2006 | William | |
| 7,219,747 | B2 | 5/2007 | Gleitman et al. | |
| 9,127,774 | B2 | 9/2015 | Wilde et al. | |
| 2007/0012442 | A1* | 1/2007 | Hearn | E21B 47/06 166/250.15 |
| 2008/0262736 | A1* | 10/2008 | Thigpen | E21B 43/128 702/9 |
| 2014/0130676 | A1 | 5/2014 | Daniels et al. | |
| 2014/0166267 | A1* | 6/2014 | Weightman | E21B 47/06 166/250.01 |
| 2014/0262238 | A1* | 9/2014 | McCrickard | E21B 43/121 166/250.01 |

(Continued)

OTHER PUBLICATIONS

"Oil Well", https://en.wikipedia.org/wiki/Oil_well, Aug. 2, 2018, 1-5.

(Continued)

*Primary Examiner* — D. Andrews

(74) *Attorney, Agent, or Firm* — Law Office of Mark Brown, LLC; Mark E. Brown

(57) ABSTRACT

A control system for and oil and gas production well includes a controller connected to a well string extending downhole from a wellhead. The control system maximizes downhole pump efficiency and oil and gas production by interactively monitoring and controlling well operating parameters. A method embodying the present invention optimizes well production and operating efficiency.

15 Claims, 5 Drawing Sheets

(56) References Cited

U.S. PATENT DOCUMENTS

| | | | | |
|---|---|---|---|---|
| 2015/0226045 | A1* | 8/2015 | Fischer | E21B 43/12<br>166/250.15 |
| 2018/0119540 | A1 | 5/2018 | Castillo | |
| 2019/0063194 | A1 | 2/2019 | Berland | |

OTHER PUBLICATIONS

"International Search Report and Written Opinion; PCT/US2020/020473", dated May 20, 2020.

* cited by examiner

To FIG. 3b

OIL AND GAS PRODUCTION WELL CONTROL SYSTEM AND METHOD

CROSS-REFERENCE TO RELATED APPLICATION

This application claims priority in U.S. Provisional Patent Application No. 62/549,036 Filed Aug. 23, 2017, which is incorporated herein by reference.

BACKGROUND OF THE INVENTION

1. Field of the Invention

The present invention relates generally to improving currently-used artificial lift methods for the production of oil, natural gas and water from vertical and horizontal wellbores, and method for use thereof, and more specifically to optimizing well and field productivity in addition to lowering power usage by improving pump efficiency leading to lower operating costs on a per unit basis, optimal field and well production, and less-frequent pump failures. This benefits operating costs, future capital costs, and in certain cases revenue due to an increase in recoverable reserves at the well and field level.

2. Description of the Related Art

Current production methods for wells on artificial lift with natural gas production tend to be inefficient from the aspect of the pump and input power usage. Gas enters the pump, which lowers pump efficiency, decreases pump life and generally creates problems for operating the well. When operators use intermittent timing cycles to operate the pump, the timing cycle is based on the well-operator-inputs to a manual type clock and timer. There is no feedback loop in the described traditional currently-used system that allows for optimizing both pump and well performance based on actual real-time data collected at the well, nor is there commonly a mechanism used to maximize pump efficiency driven by a real time feedback loop. This lack of real-time data analysis also provides no predictive maintenance information on pump operation and increases outage times when sudden pump failures occur.

Another production method sometimes used involves incorporating what is known as a "Pump Off Controller" (POC) procedure, which attempts to maximize the pumping-system (not necessarily the well producing horizon itself) efficiency by measuring operating parameters such as the stress/strain relationship on the polish rod, and possibly input parameters at the prime mover. POCs do include feedback via parameters being measured, but the overall system efficiency is limited due to changing flow regimes at the pump intake, and are beyond the control of the POC.

Heretofore, there has not been available a system or method for using real-time, instantaneous well performance data to optimize well production by recognizing changing downhole flow regimes and actively changing same to improve power system and pump efficiency performance, and further increasing reservoir production and recovery factors, with the advantages and features of the present invention.

BRIEF SUMMARY OF THE INVENTION

The present invention generally provides a novel system and method for using data acquired at the well by gas metering and understanding the relationship between flow rate and impact on flow regimes in the well in such a way as to optimize the reservoir performance of the well, increasing down-hole pump efficiency, reducing input power requirements, providing pump predictive maintenance information, and optimizing the entire gathering system when used on a field-wide application. This system will optimize both well reservoir performance in addition to pumping system performance. This is different from POC systems which, in essence, are attempting to optimize the pumping system but not the actual well production.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning. Well "backside" refers to the annular space between the well tubing and casing, and is the conduit of production for the gas stream and any liquids the well can produce while flowing naturally. Tubing refers to a small diameter pipe system that, in an artificially lifted well, is intended to be the conduit of travel for liquid phases of both oil and water. Well "loading" refers to a state of gas flow that is impeded by simultaneous liquids production that slows the rate of gas flow rate, ultimately to a no-flow condition if loading is allowed to continue.

II. Systems Embodying Aspects of the Invention

Figure 1:
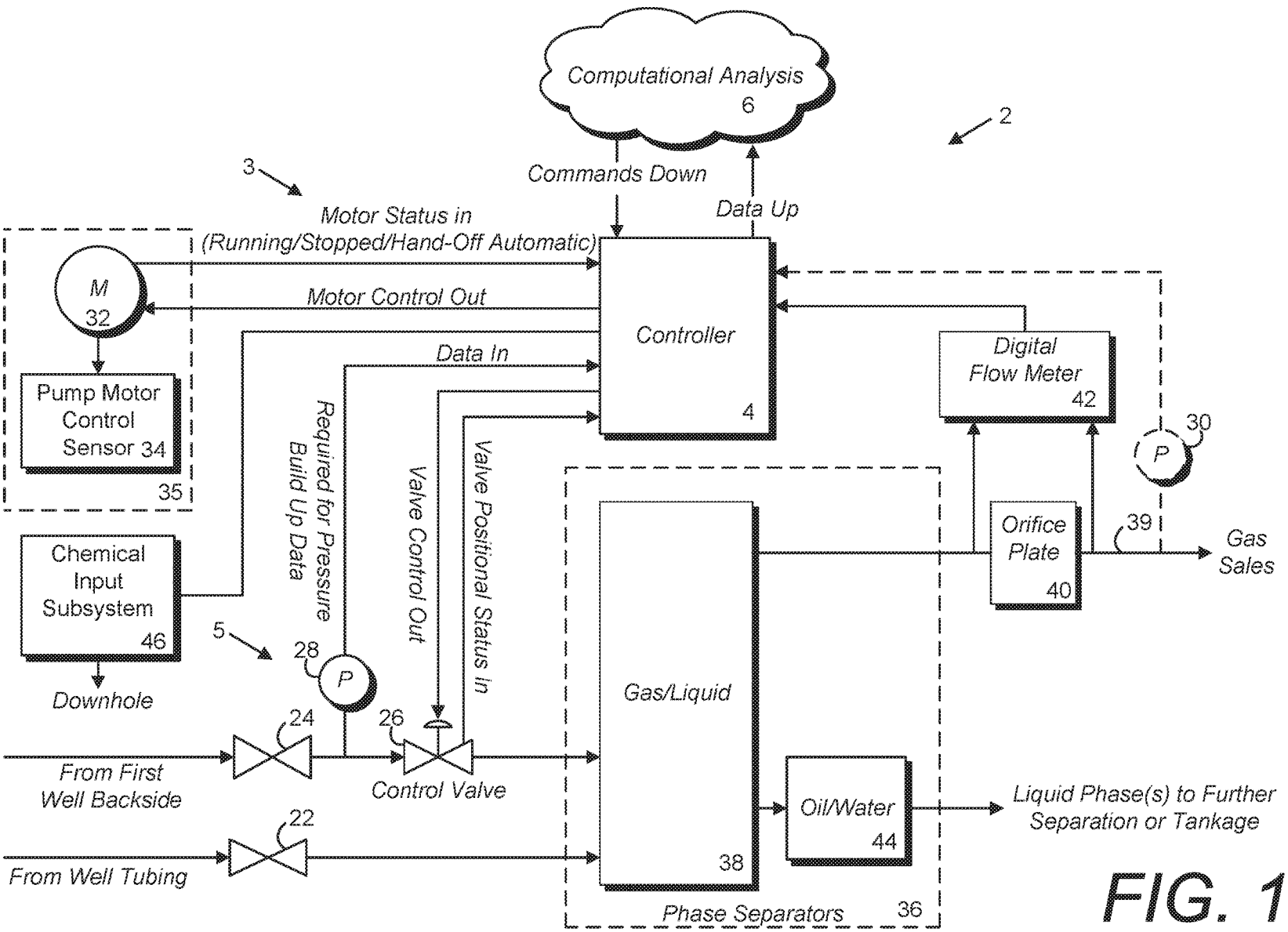
FIG. 1 is a schematic, block diagram of an oil and gas production well system embodying an aspect of the present invention.

FIG. 1 shows an oil and gas production well control system 2 including a well 3 and a controller 4. The controller 4 can be connected to the Internet (i.e., "cloud") 6, e.g., wirelessly or directly. The system 2 can perform computational analysis in the cloud 6 by providing data input from the controller 4, which can download commands from the cloud 6. Alternatively, data processing and system control functions can be provided by a standalone computer or a network of computers. Still further, such processing capability can be incorporated in "smart" components of the system 2.

Figure 2:
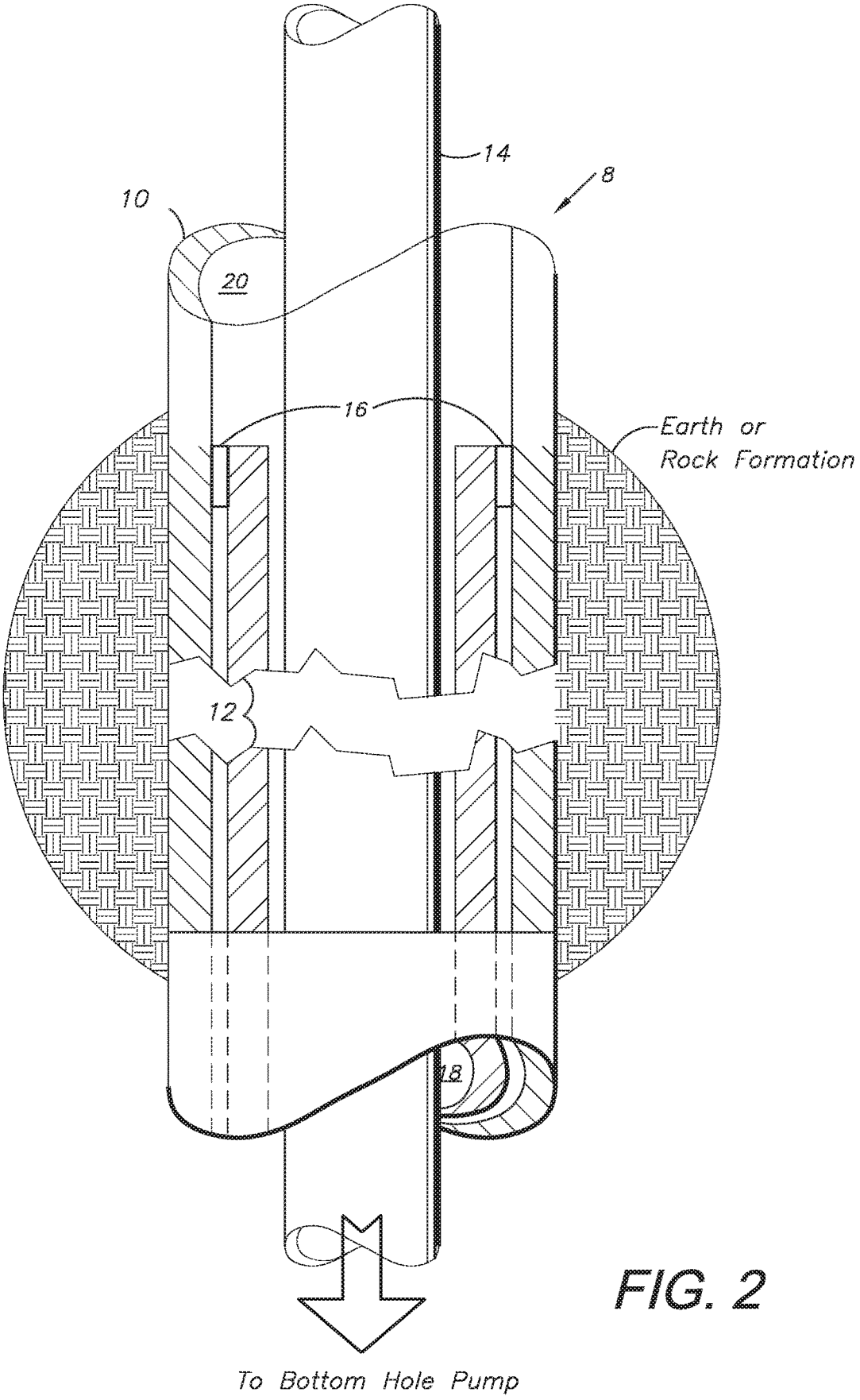
FIG. 2 is a fragmentary, elevational view of an oil and gas production wellstring for producing liquids via a pump within a tubing string and producing natural gas via a backside of the well, with portions broken away to reveal internal construction.

The system 2 includes a wellstring 8 (multiple production wells can be included in the system and driven by a single-point cloud/software system). Conventional production wellstrings can include an outermost casing 10, an intermediate liner 12 and an innermost tubing 14. Such production wellstring components can be installed downhole as individual sections connected at their respective ends. Casings 10 can be cast-in-place downhole. Liners 12 commonly terminate subsurface, and can be suspended from the casing 10 by hangers 16. U.S. Pat. No. 7,090,027 shows casing hanger assemblies, and is incorporated herein by reference. As shown in FIG. 2, the wellstring 8 includes a first backside 18 comprising an annular space between the liner 12 and the tubing 14. A second backside 20 comprises an annular space between the casing 10 and the tubing 14. The wellstring 8 is connected to a pump subsystem 35, which includes a motor 32 and a pump motor control sensor 34. The pump subsystem motor 32 can reciprocate a conventional pump jack (not shown), or drive various other downhole pump configurations such as progressive cavity and electric submersible pumps. Various alternative production well constructions can include the control system and perform the method of the present invention.

As shown in FIG. 1, well tubing production (generally oil and water in liquid phase) exits a wellhead 5 via a tubing valve 22 and backside 20 production (generally gas, which can include entrained liquids) exits the wellhead 5 via a backside valve 24, which flows through a control valve 26 connected to the controller 4. The controller 4 can be programmed to provide positioning signals to the control valve 26 in response to controller input, including control valve 26 positional status, preprogrammed operating parameters and conditions, and pressure data detected at upstream and downstream transducers 28, 30, which data can be utilized in computing system output flow rates.

The controller 4 is also interactively connected to a motor or prime mover 32, which can include a pump motor control/sensor 34. The motor 32 can utilize variable frequency drive ("VFD") technology. Motor 32 status conditions can be running, stopped or hand-off automatic ("HOA"), which status conditions can be input to the controller 4.

Production enters a phase separator subsystem 36 via the valves 22, 26. The phase separator subsystem 36 includes a gas/liquid phase separator 38 wherein gas and liquid (i.e., oil and water) phases are separated, preferably at the surface. The gas flow proceeds down a sales line 39 that typically includes a differential pressure ($P_{DIFF}$) meter 42 to monitor and record the natural gas production. This measurement is done using typical gas parameters as a function of temperature and pressure, as well as using an orifice plate 40 of known restriction such that the instantaneous production rate can be calculated via the measured pressures on either side of the orifice plate 40. A difference in pressure between these two points of measurement ($P_{DIFF}$) indicates flow rate. The instantaneous well gas production is directly proportional to the $P_{DIFF}$ recorded at the meter 42, which records both orifice plate 40 well side and flowline side measured pressures, the calculated $P_{DIFF}$, and the calculated production flow rate as functions of time via an internal clock.

The production flow rate can be input to the controller 4. Alternatively, $P_{DIFF}$ can be independently derived from the upstream and downstream pressure transducers 28, 30. It should be noted that if data from a flow meter is available to the system for $P_{DIFF}$, then pressure transducer 30 is not required as part of the system. Custody (ownership) of the gas output can transfer at the digital flow meter 42, which operates as a discrete external input source. Alternatively, the custody transfer can occur downstream whereby the alternative configuration design choice based on an as-built design at the well site with upstream and downstream pressure transducers 28, 30 may be preferred. Such $P_{DIFF}$ is proportional to gas flow volume throughput and can provide quantity data as needed for the gas sales line 39 downstream of the system 2. Liquid output from the gas/liquid separator 38 enters an oil/water separator 44, and exits to further separation, disposal, oil sales, tankage, etc.

The system 2 uses instantaneous $P_{DIFF}$ information and, via computation in a proprietary algorithm using cloud architecture, determines the optimal state of operation of both the downhole pump (controlled by the motor 32 located at the surface wellhead 5) and the automated control valve 26 between the well first backside or annulus 18 and the gas/liquid separator 38, as shown in FIG. 1. The upstream pressure measurement transducer 28 (between the wellhead 5 and the control valve 26) inputs pressure data to the controller 4 for use with flow meter 42 data. The $P_{DIFF}$ can be supplied by the flow meter 42, or if this is not feasible, by using the wellhead upstream pressure transducer 28 in combination with the (optional) downstream transducer 30 inserted into the flowline on the downstream side of the orifice plate 40. The control system 2 is pump "agnostic" and can be used with reciprocating tubing insert pumps, progressive cavity pumps, electric submersible pumps, etc.

In a high gas-flow-rate condition via the second back side 20, the operating downhole pump subsystem 35 will intake gas as well as liquids during the pumping cycle. In the same condition, the flow meter 42 will register a 'high' $P_{DIFF}$. During this condition there is no need to operate the pump subsystem 35, and the system 2 recognizes this regime condition and optimizes by the well controller 4 opening the control valve 26 and maintaining the downhole pump subsystem 35 condition in "Off." As the well 3 continues to operate in this condition, both liquids and gas are flowing into the well 3, and both are attempting to flow via the backside 18. As the bottom hole pressure of the well struggles to lift both the liquids and gas from the well 3 due to an increase (gradual or sudden) in dynamic head, the flow rate decreases. This will be evidenced as decreasing $P_{DIFF}$ at the flow meter 42 (or independently derived as described elsewhere if flow meter 42 is not available). The cloud software 6 will continue monitoring $P_{DIFF}$ until the logic determines a necessity to close the control valve 26 and begin a pumping condition cycle.

When the controller 4 initiates the pumping condition, the control valve 26 is automatically closed, halting fluid upflow in the first backside 18 ($V_{UPFLOW}=0$). Gravity segregation will naturally occur in this zero velocity backside environment, and the liquid phases will 'fall' to the bottom of the well 3 for intake by the pump subsystem 35.

A chemical input subsystem 46 can be connected to the well 3 and controlled by the controller 4 for controlling well treatment. Treatment plans are commonly implemented with such chemical input subsystems, which can inject anti-scaling, paraffin-eliminating and other control chemicals downhole. As the $P_{DIFF}$ naturally decreases after a flowing cycle and immediately after shutting in the control valve 26, the controller 4 would initiate operation of the chemical input subsystem 46 (e.g., pumps) to place chemicals in the backside (18 and/or 20) of the well 3 as it changes state from production to gravity segregation in a pumping cycle.

The controller 4 will then start the bottom-hole pump subsystem 35 via the (surface or downhole, depending on lift system employed at well) motor 32 and commence pumping since liquids are now at the pump intake and gas is segregating upward, thus creating a rising pressure seen at the pressure transducer 28 located near the control valve 26. The cloud 6 can either be programmed to calculate the fluid production based on well operating parameters, or a sensor 34 can be added to the system 2 to actually measure the pump motor rotations or stroke rates with this data supplied to the controller 4, thus enabling a more robust liquid production calculation.

The cloud 6 can incorporate machine learning techniques to optimize the well production as a function of run time of the pump subsystem 35, as well as establishing well performance optimization based on analysis of various pressure build up and flow-down rates and time frames seen at the control valve pressure transducer 28 and $P_{DIFF}$, respectively. Certain wellbore construction and operating parameters can be input into the software architecture and the software will determine superficial gas velocities for all wellbore topologies present. The system 2 will estimate critical velocities for each discrete wellbore topology and will use this information as a baseline for determining the starting point for the shut-in state of the system 2, thus maximizing the in situ well energy and thereby increasing both the life and the expected ultimate reserves recovery of the well. During the shut-in phase, the system 2 will monitor, record and learn from the nature of the pressure buildup: slope(s) of buildup, time to build to certain pressures, etc. The cloud 6 can be programmed to perform a Fast Fourier Transform on each buildup pressure and note the frequency domain and distribution of same, comparing each signature with various production and pressure buildup characteristics as an aid in determining when various production stages are contributing to wellbore fillage and production.

The control system 2 can warn of impending pump failure by continually analyzing the time cycle duration and subsequent number of pump strokes required to obtain a given backside pressure buildup. The control system 2 will also lead to optimization of existing gathering systems and compression when used on a field-wide basis. Wells at a greater distance from field compression will have greater line pressure losses to overcome compared to wells closer to the compressor for a given flow rate. By monitoring and regulating flow times and rates of all wells on the system as well as actual system pressures, the cloud 6 can determine the optimum time to produce wells further down the gathering system line by coordinating the flow time with pumping times of other wells on the system to lower the backpressure seen at the producing wells.

III. Methods Embodying Aspects of the Invention

Figure 3A:
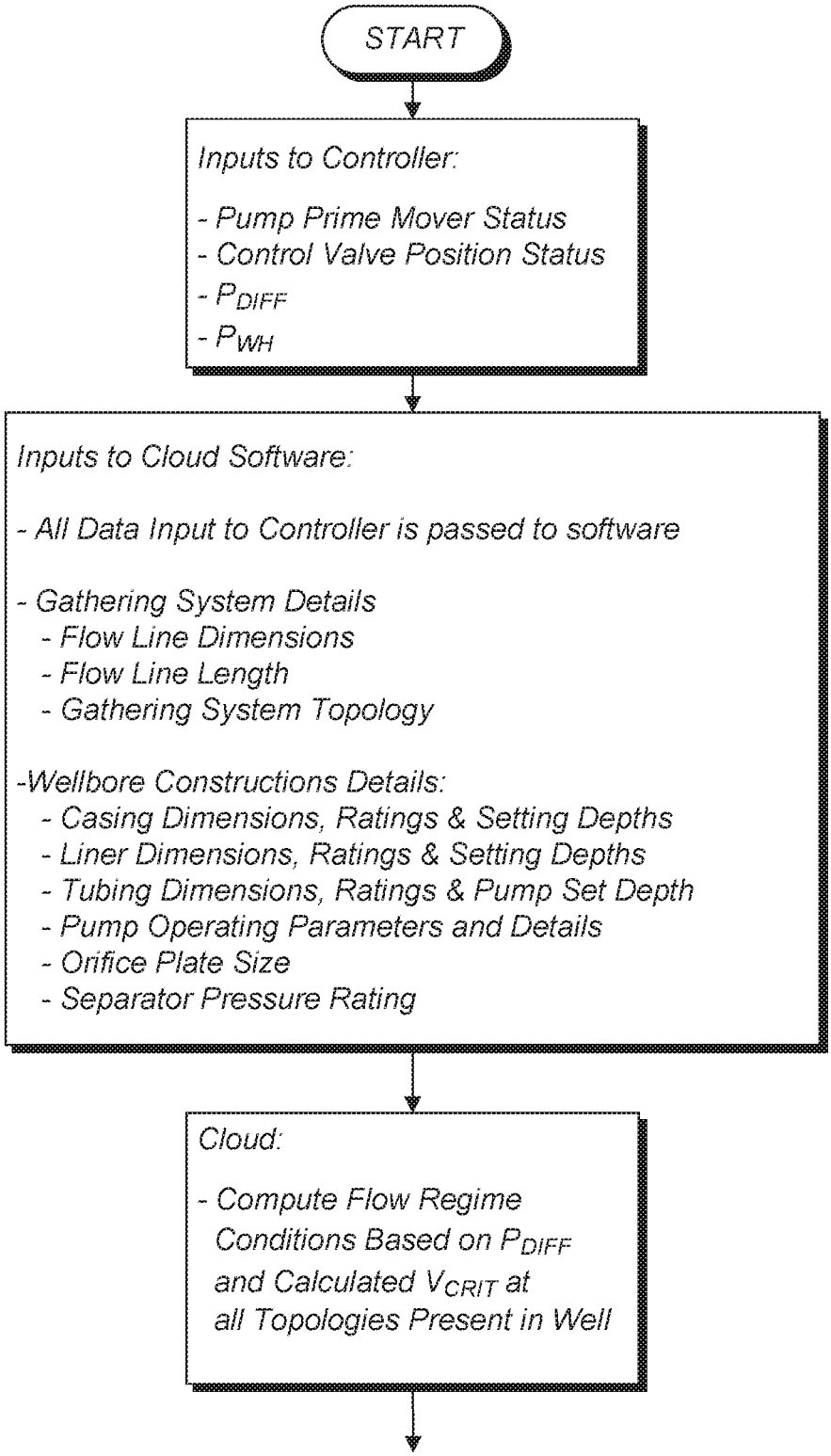
FIGS. 3*a*-3*c* show a flowchart of a method of the present invention.
Figure 3B:
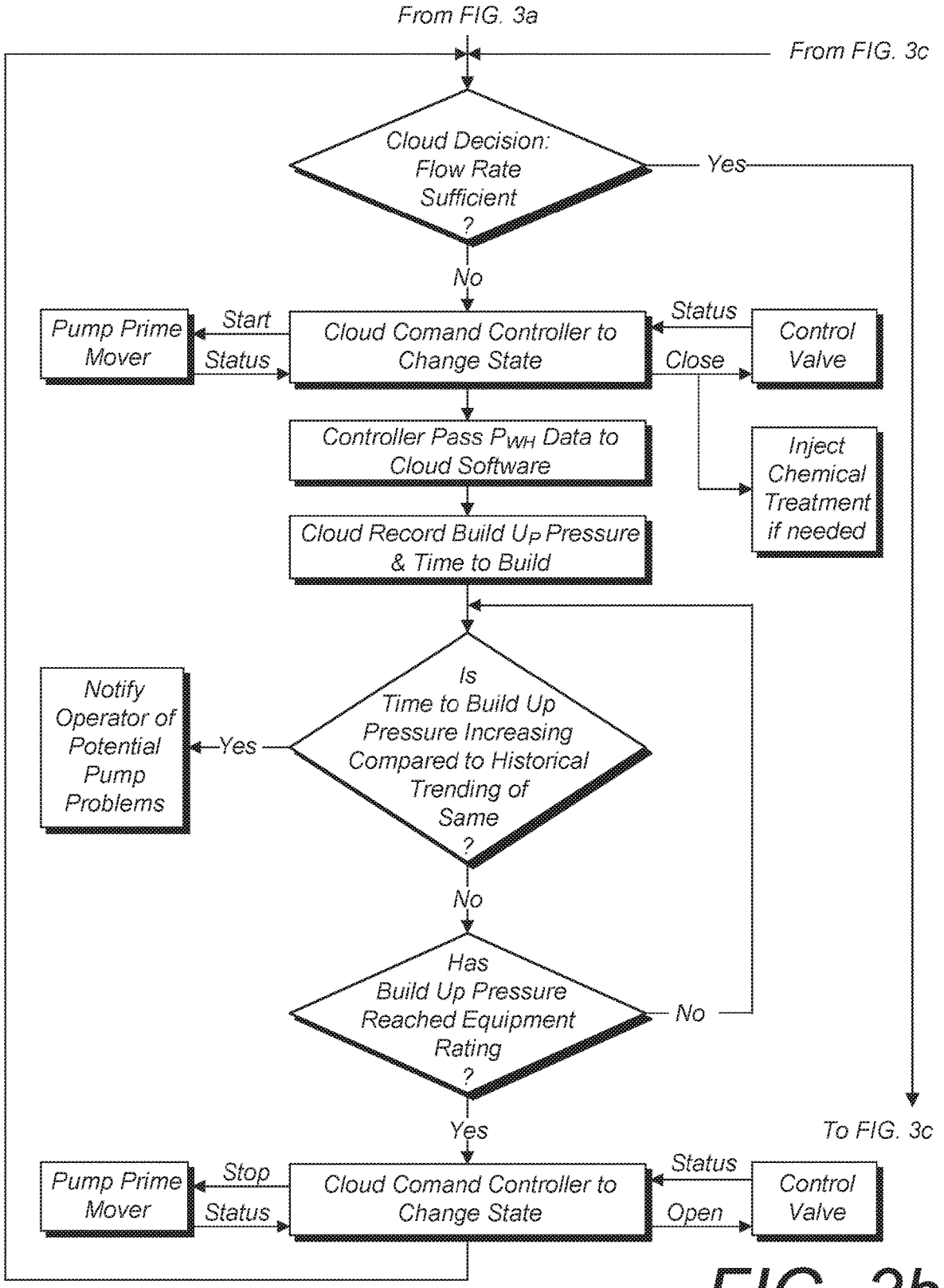
Figure 3C:
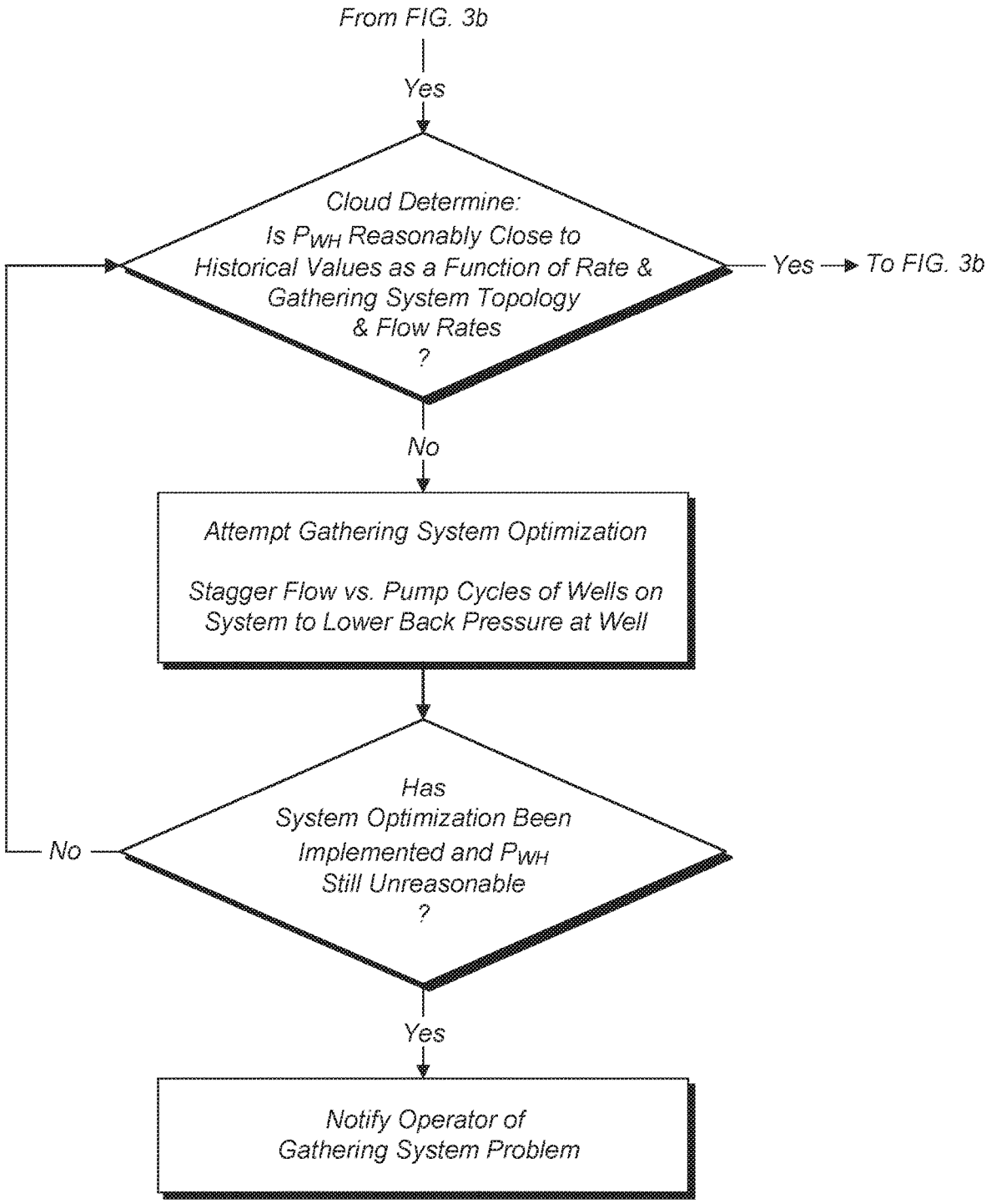

FIGS. 3*a*-3*c* show a flowchart for a non-limiting, exemplary method of practicing the present invention. Various other steps, sequences and operating parameters can utilize the inventive method.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A control system for an oil and gas production well including: a subsurface borehole; casing lining the borehole; a liner within the casing; tubing with lower and upper ends; said tubing located within the casing; an annular casing-tubing backside between the casing and the tubing; a downhole pump connected to said tubing lower end; a prime mover connected to said downhole pump; and a surface wellhead connected to said tubing upper end, said surface wellhead receiving at a production flow rate primarily oil production through said tubing and primarily gas production through said casing-tubing backside, said control system including:

a control valve connected to said casing-tubing backside and said surface wellhead;

a programmable controller connected to said pump prime mover, said casing-tubing backside and said surface wellhead, said controller configured for adjustably controlling the production flow rate to said wellhead;

said controller programmed with a control algorithm:

equating the gas flow rate at the pump to the backside gas flow rate as computed from measurements taken at the surface wellhead;

computing a predicted instantaneous gas velocity at the downhole pump based on operating parameters specific to said well;

correlating gas velocity at said pump with gas volume intake to said pump;

analyzing surface backside pressure data including computation of the time-dependent rate of change based on said downhole pump prime mover;

transforming surface backside pressure from time domain to frequency domain;

monitoring changes in frequency attenuation and harmonic distribution of said surface backside pressure as a function of control valve position and said pump prime mover operation;

detecting transient changes in the state of gas flow in the well and operational changes in the pumping system components; and commanding a state change of the control valve position and the pump prime mover operation in response to said transient changes in the state of gas flow and said operational changes in the pumping system components.

2. The control system according to claim 1 wherein said production well includes a phase separator configured for separating gas and liquid phases of said production well output.

3. The control system according to claim 1 wherein said well operating parameters include pressure differential ($P_{DIFF}$) along said backside to a gas output line.

4. The control system according to claim 3 wherein said well operating parameters include production fluid uphole velocities.

5. The control system according to claim 4 wherein said production fluid uphole velocities are a function of said $P_{DIFF}$ operating parameters.

6. The control system according to claim 1, which includes a cloud-based program receiving input from and providing output to the controller.

7. The control system according to claim 6 wherein said cloud-based software inputs and outputs comprise said system operating parameters.

8. The control system according to claim 1 wherein said controller is programmed with an algorithm for computing said operating parameters.

9. The control system according to claim 1 wherein said well operating parameters include downhole pump, prime mover and in-situ well energy operating parameters.

10. The control system according to claim 1, wherein said controller is configured to record frequency domain and distribution signatures of said buildup pressures and compare said buildup pressure signatures with production and pressure buildup characteristics for determining when well production stages are contributing to wellbore fillage and production.

11. The control system according to claim 1 wherein said time-to-frequency domain transformation comprises a Fast Fourier Transform.

12. The control system according to claim 1 wherein:

said control system is connected to the Internet; and said controller is configured for operating a cloud-based program receiving said operating parameters from said multiple producing wells as input.

13. The control system according to claim 1 wherein said prime mover is located downhole.

14. The control system according to claim 13 wherein said downhole pump comprises an electric, submersible pump (ESP).

15. The control system according to claim 1, which includes:

a producing field of multiple said oil and gas producing wells;

each said producing well comprising a subsurface borehole; casing lining the borehole; a liner within the casing; an annular backside between the liner and the tubing; a downhole pump; and a surface wellhead; and said control system receiving production data from said multiple producing wells and simultaneously and interactively controlling operating parameters of the pump prime movers and the control valves of said producing wells.

* * * * *